US008508321B2

(12) United States Patent
Wu

(10) Patent No.: US 8,508,321 B2
(45) Date of Patent: Aug. 13, 2013

(54) RELAY WITH MULTIPLE COILS

(75) Inventor: Sung Jen Wu, New Taipei (TW)

(73) Assignee: Song Chuan Precision Co., Ltd., New Taipei (TW)

( * ) Notice: Subject to any disclaimer, the term of this patent is extended or adjusted under 35 U.S.C. 154(b) by 0 days.

(21) Appl. No.: 13/489,420

(22) Filed: Jun. 5, 2012

(65) Prior Publication Data

US 2012/0242430 A1 Sep. 27, 2012

Related U.S. Application Data

(63) Continuation-in-part of application No. 12/857,561, filed on Aug. 17, 2010, now abandoned.

(51) Int. Cl.
*H01H 51/22* (2006.01)
*H01H 67/02* (2006.01)

(52) U.S. Cl.
USPC ..... 335/78; 335/131

(58) Field of Classification Search
USPC ..... 335/131, 132, 126, 127, 106
See application file for complete search history.

(56) References Cited

U.S. PATENT DOCUMENTS

| | | | | | |
|---|---|---|---|---|---|
| 1,636,609 | A * | 7/1927 | Klann | 335/132 |
| 1,789,417 | A * | 1/1931 | Shepard | 335/244 |
| 2,291,923 | A * | 8/1942 | Schmidt | 335/253 |
| 2,527,220 | A * | 10/1950 | Hughes | 335/243 |
| 2,540,022 | A * | 1/1951 | Rabenda | 335/266 |
| 2,728,880 | A * | 12/1955 | Ashworth | 335/230 |
| 3,259,812 | A * | 7/1966 | O'Neil | 335/266 |
| 3,519,967 | A * | 7/1970 | Kruzic et al. | 335/132 |
| 3,708,769 | A * | 1/1973 | Caltabiano | 335/132 |
| 3,733,516 | A * | 5/1973 | Grunert et al. | 361/56 |
| 4,563,663 | A * | 1/1986 | Niekawa et al. | 335/78 |
| 4,987,397 | A * | 1/1991 | Held | 335/131 |
| 5,243,312 | A * | 9/1993 | Schedele | 335/78 |
| 5,245,303 | A * | 9/1993 | Aharonian | 335/78 |
| 5,781,089 | A * | 7/1998 | Doneghue | 335/78 |
| 6,483,407 | B1 * | 11/2002 | Matsuda et al. | 335/78 |
| 6,489,868 | B1 * | 12/2002 | Sato et al. | 335/78 |
| 6,590,480 | B2 * | 7/2003 | Matsuda | 335/78 |
| 6,798,322 | B2 * | 9/2004 | Copper et al. | 335/128 |
| 6,853,275 | B2 * | 2/2005 | Sato et al. | 335/128 |
| 7,283,026 | B2 * | 10/2007 | Nakamura et al. | 335/78 |
| 7,598,831 | B2 * | 10/2009 | Braun et al. | 335/196 |
| 7,982,567 | B2 * | 7/2011 | Cartier Millon et al. | 335/229 |
| 2004/0080389 | A1 * | 4/2004 | Nishida et al. | 335/132 |
| 2008/0258851 | A1 * | 10/2008 | Trottmann et al. | 335/131 |

* cited by examiner

*Primary Examiner* — Alexander Talpalatski

(57) ABSTRACT

A relay with multiple coils includes a base which has two fixed contacts, a coil assembly which has a U-shaped armature, a U-shaped iron core, two tubular bobbins received between the U-shaped armature and the U-shaped iron core, two coils respectively wound around the tubular bobbins. A spring member is movable above the coil assembly. The spring member has two moving contacts corresponding to the fixed contacts. A coil spring is disposed between the spring member and the coil assembly. When each coil induces a magnetic field by supplying electric current, the coil spring is compressed such that the moving contacts connect with the fixed contacts; when no electric current is supplied, the coil spring provides the restoring force to draw the spring member backward. Therefore, the relay acts as a switch for adapting to open/close a circuit connected to the relay.

6 Claims, 7 Drawing Sheets

RELAY WITH MULTIPLE COILS

CROSS-REFERENCE TO RELATED APPLICATION

This application is a Continuation-In-Part application of Ser. No. 12/857,561, filed 17 Aug. 2010, and entitled "RELAY WITH MULTIPLE COILS", now pending.

BACKGROUND OF THE INVENTION

1. Field of the Invention

The present invention relates to a relay with multiple coils, and more particularly to a relay having multiple coils disposed thereon for increasing an efficiency of an electromagnetic induction and lowering a consumption of the coils.

2. Description of Related Art

A relay is an electrically operated switch for controlling a circuit by applying a low electric current. The most common types of relays used are electromechanical relays, reed relays, and solid state relays, etc. A conventional electromagnetic relay in accordance with the prior art comprises an iron core. A single coil is wound around the iron core. A magnet is disposed above the iron core and the single coil. A spring is connected to the magnet for restoring the magnet. Accordingly, two distal ends of the single coil is respectively applied two different voltages to generate an electric current for passing through the single coil, such that a magnetic field is induced by the electric current for attracting the magnet to move toward the iron core. And when no electric current passes through the single coil, the magnetic field is disappeared. The magnet is drawn back by the spring.

However, the conventional electromagnetic relay only has the single coil. The induced magnetic field can be enhanced without changing the input voltages by increasing a length or a diameter of the coil or increasing a length of the iron core. This causes an increase of a size of the single coil and is inconvenient to dispose on a small-scale relay.

The present invention has arisen to mitigate and/or obviate the disadvantages of the conventional electromagnetic relay with a single coil.

SUMMARY OF THE INVENTION

The main objective of the present invention is to provide an improved relay with multiple coils for increasing an induced magnetic field.

To achieve the objective, a relay with multiple coils comprises a base having at least two fixed contacts disposed thereon, a coil assembly mounted on the base, the coil assembly further comprising at least one U-shaped armature, at least one U-shaped iron core, at least two tubular bobbins respectively and coaxially receive between the U-shaped armature and the U-shaped iron core, at least two coils respectively and coaxially wound around each of the tubular bobbins, a spring member movably located above the coil assembly, the spring member having at least two moving contacts respectively disposed on two opposite ends thereof for corresponding to each of the fixed contacts of the base, at least one protecting insulator rivetedly mounted on a bottom of the spring member, the top of the U-shaped armature enclosed by the protecting insulator such that the U-shaped armature is indirectly mounted on the spring member, at least one coil spring compressively disposed between the spring member and the coil assembly, the spring member selectively provides a restoring force between the moving contacts and the fixed contacts; wherein when each coil of the coil assembly is induced a magnetic field by supplying electric current, the U-shaped armature mounted on the spring member is magnetically attracted to move toward and connect with the U-shaped iron core by the magnetic field and the coil spring is vertically compressed by the U-shaped armature such that the two moving contacts simultaneously move downwardly to connect with the two fixed contacts of the base; when no electric current is supplied to the two coils and the magnetic field is disappeared, the coil spring provides the restoring force to draw the spring member backward such that the moving contact moves upwardly to leave the fixed contact again; thereby the relay acts as a switch for adapting to open/close a circuit connected to the relay.

Each of the U-shaped armatures has two spaced upper legs extending downwardly therefrom and each of the U-shaped iron cores has two spaced lower legs extending upwardly therefrom.

Each of upper legs has an indentation and each of the lower legs has a protrusion; thereby the U-shaped iron core is firmly engaged with the U-shaped armature by an engagement between the indentations and the protrusions.

Each of upper legs has a protrusion and each of the lower legs has an indentation; thereby the U-shaped iron core is firmly engaged with the U-shaped armature by an engagement between the indentations and the protrusions. Each tubular bobbin selectively has a round cross section or a square cross section.

Further benefits and advantages of the present invention will become apparent after a careful reading of the detailed description with appropriate reference to the accompanying drawings.

DETAILED DESCRIPTION OF THE INVENTION

Figure 1:
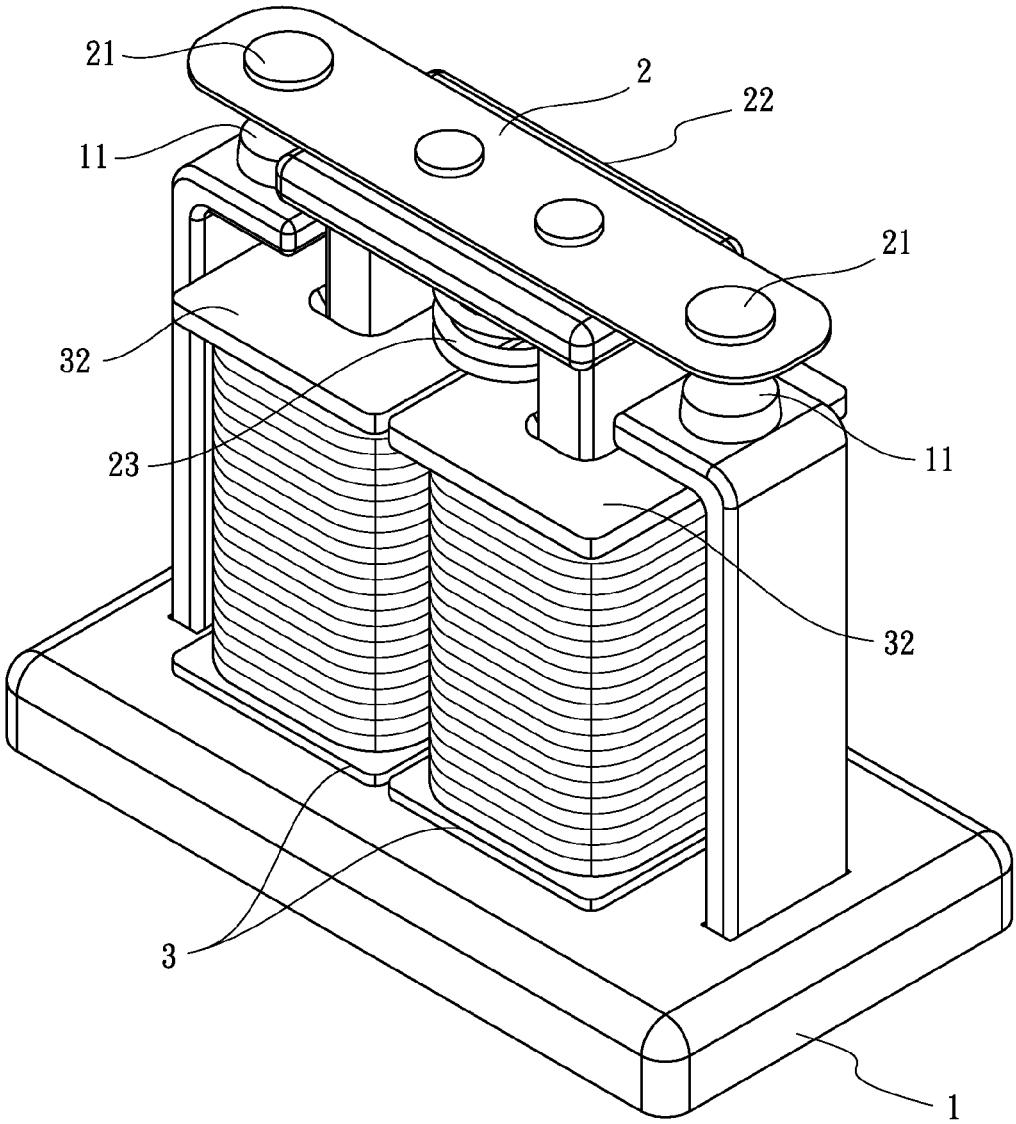
FIG. 1 is a perspective view of a preferred embodiment of a relay with multiple coils in accordance with the present invention.
Figure 2:
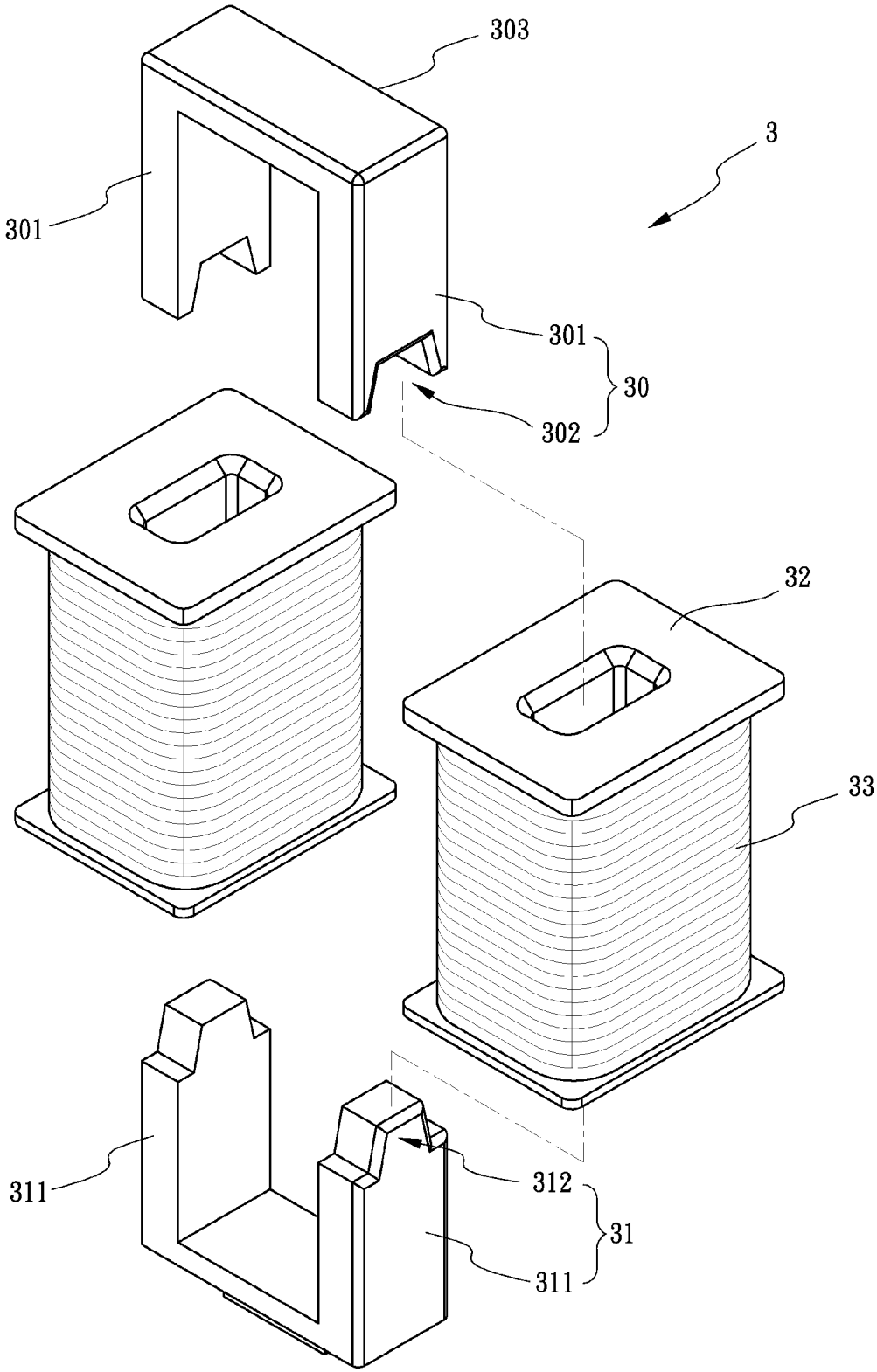
FIG. 2 is an exploded view of a coil assembly.
Figure 3:
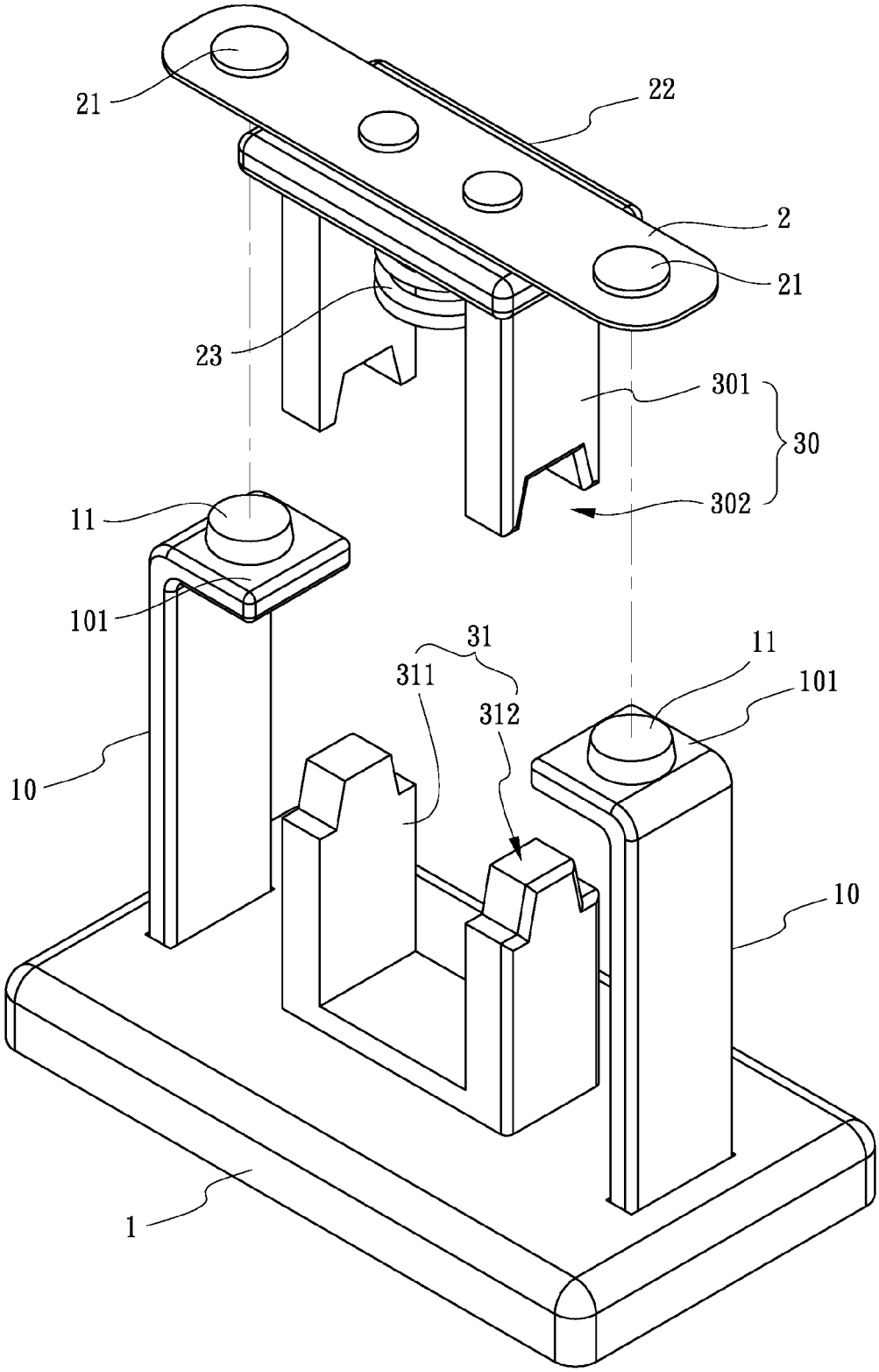
FIG. 3 is an exploded view of the preferred embodiment of the relay with multiple coils without two tubular bobbins and coils.

Referring to the drawings and initially to FIGS. 1-3, a relay with multiple coils in accordance with a preferred embodiment of the present invention is in a vertical motion version and comprises a base 1 having two inverted L-shaped support members 10 vertically disposed on two opposite sides of a top thereof. Each of the support members 10 has an laterally orieted end portion 101 on which a fixed contact 11 is provided (Here is one pair of fixed contacts 11 in the present embodiment).More specifically, each of the fixed contacts 11 is disposed on a top surface of the respective end portion 101 of the support member 10.

A coil assembly 3 is mounted on the top of the base 1 and located between the two support members. The coil assembly 3 comprises at least one U-shaped armature 30 which has a middle section 303 and two spaced upper legs 301 extending downwardly from the middle section 303, at least one U-shaped iron core 31 which has two spaced lower legs 311 extending upwardly therefrom, and at least two tubular bobbins 32 respectively and coaxially surround the upper legs 301 of the U-shaped armature 30 and the lower legs 311 of the U-shaped iron core 31 (Here are one U-shaped armature 30, one U-shaped iron core 31 and one pair of tubular bobbins 32 in the present embodiment). Each tubular bobbin 32 has a square cross section. At least two coils 33 are respectively and coaxially wound around the tubular bobbins 32. Each of upper legs 301 has an indentation 302 taped upward. Each of the lower legs 311 has a protrusion 312 taped upward. The U-shaped iron core 31 is able to be firmly engaged with the U-shaped armature 30 by an engagement between the indentations 302 and the protrusions 312, such that the engagement can prevent the U-shaped armature 30 and the U-shaped iron core 31 from bias movement due to any electromagnetic interaction between two tubular bobbins 32 with coils 33.

Figure 5:
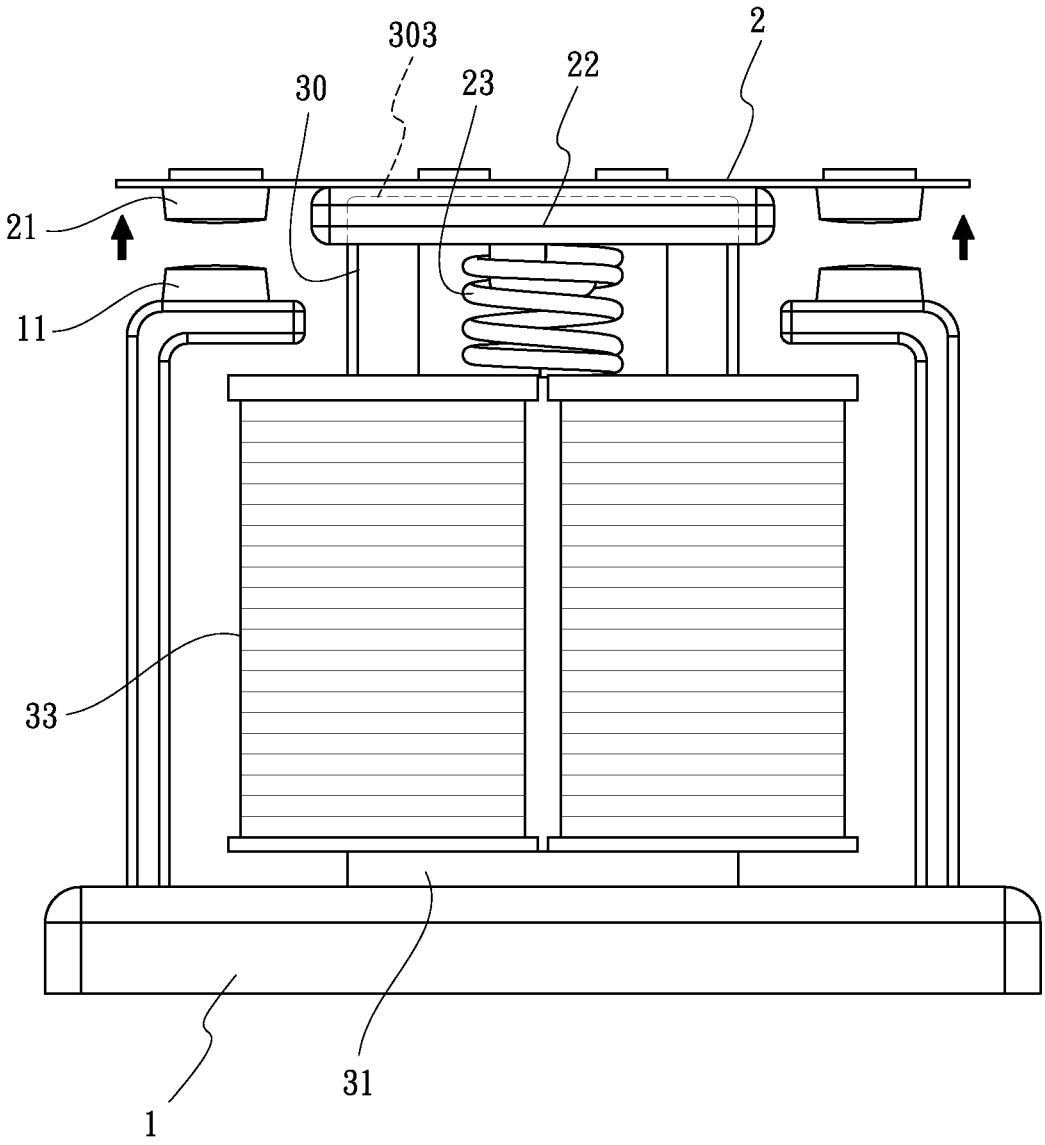
FIG. 5 is a front side view to show the spring member moving back when no electric current is supplied to the coils and the magnetic field is disappeared.

A spring member 2 is movably located above the coil assembly 3. The spring member 2 has at least two moving contacts 21 respectively disposed on two opposite ends thereof for corresponding to fixed contacts 11 of the base 1 (Here is one pair of moving contacts 21 in the present embodiment). At least one protecting insulator. 22 is rivetedly mounted on a bottom of the spring member 2 (Here is one protecting insulator 22 in the present embodiment). The middle section of the U-shaped armature 30 is enclosed by the protecting insulator 22 such that the U-shaped armature 30 is indirectly mounted on the. spring member 2. At least one coil spring 23 is compressively disposed between the middle section 303 of the armature 30 and the two bobbins 32 (Here is one coil spring 23 in the present embodiment) to normally urge the armature 30 to an upper postion where the fixed contacts 11 and the moving contacts 21 are spaced apart, as shown in FIG. 5. That is, one end of the coil spring 23 is abutting against the protecting insulator 22 and another end of the coil spring 23 is abutting against the tubular bobbins 32. In this way, the coil spring 23 selectively provides a restoring force between the moving contact 21 and the fixed contact 11.

Figure 4:
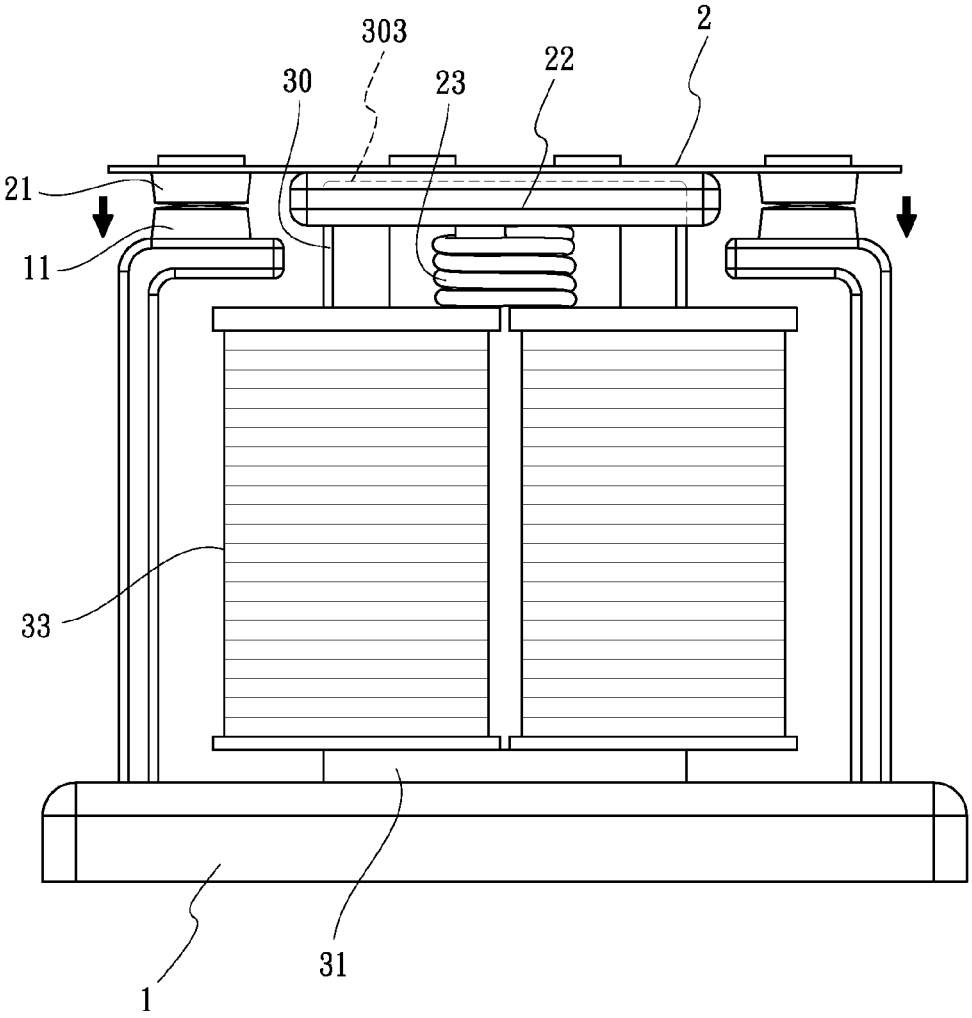
FIG. 4 is a front side view to show a spring member moving toward the coil assembly when coils are induced a magnetic field by supplying electric current.

The operation of the relay with multiple coils in accordance with the present invention will be described in detailed below. As shown in FIG. 4, when each coil 33 of the coil assembly 3 is induced a magnetic field by supplying electric current, the U-shaped armature 30 mounted on the spring member 2 is magnetically attracted to move toward and connect with the U-shaped iron core 31 by the magnetic field. Simultaneously, the coil spring 23 is vertically compressed by the U-shaped armature 30 and the spring member 2 moves downwardly with the attracted U-shaped armature 30 to have the two moving contacts 21 connect with the two fixed contacts 1.

As shown in FIG. 5, when no electric current is supplied to the two coils 33 and the magnetic field is disappeared, the coil spring 23 provides the restoring force to draw the spring member 2 and the moving contact 21 backward. The moving contact 21 moves upwardly to leave the fixed contact 11 again. Accordingly, the relay with multiple coils acts as a switch for opening/closing a circuit (not shown) connected to the relay.

Figure 6:
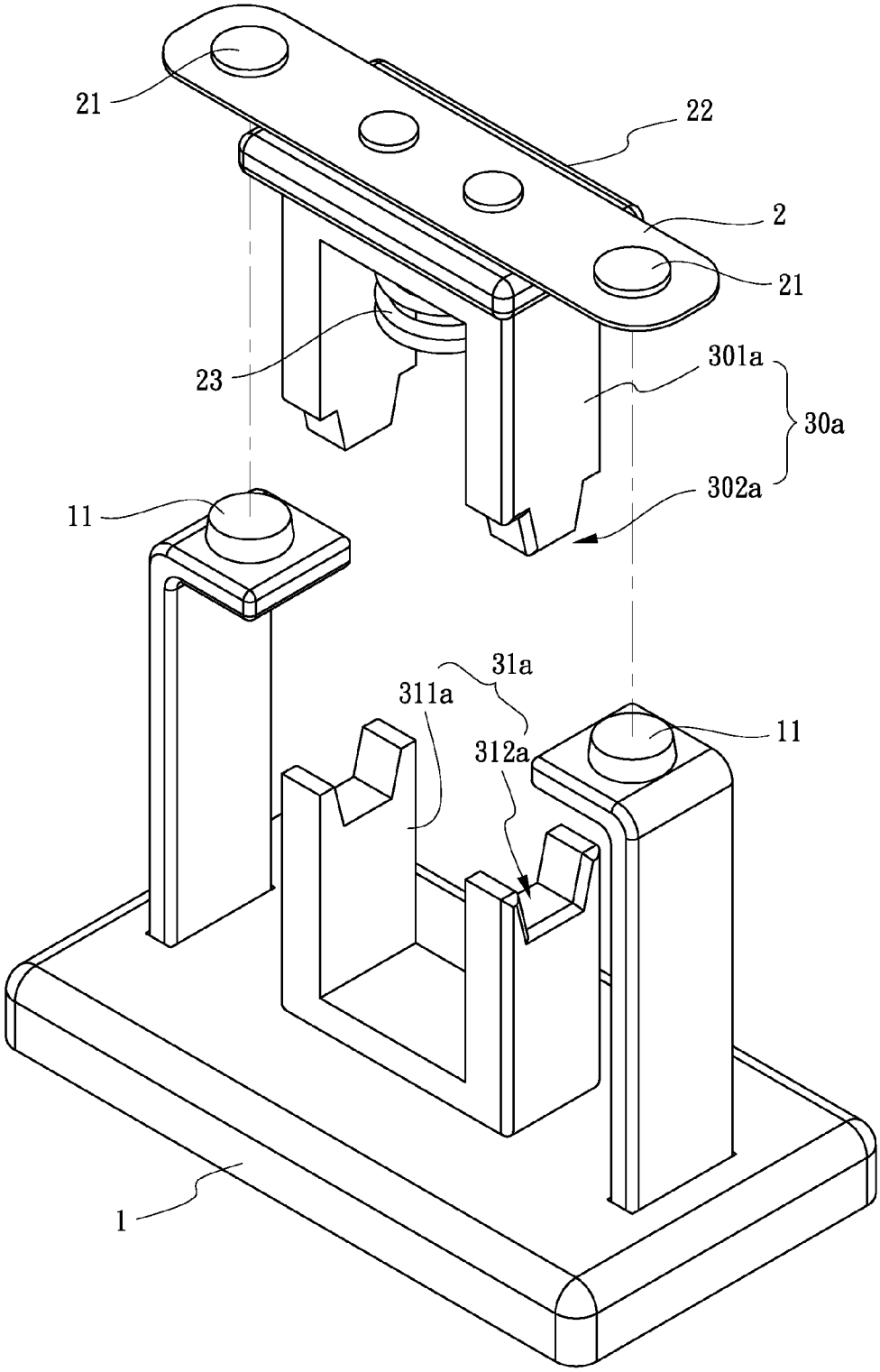
FIG. 6 is an exploded view of the second embodiment of the relay with multiple coils without two tubular bobbins and coils.

With reference to FIG. 6, that shows a second embodiment of the relay with multiple coils in accordance with the present invention. The elements and effects of the second embodiment which are the same with the preferred embodiment are not described, only the differences are described. In this embodiment, a U-shaped armature 30*a* has two spaced upper legs 301*a* extending downwardly therefrom. Each of upper legs 301*a* has a protrusion 302*a* tapered downward. A U-shaped iron core 31*a* has two spaced lower legs 311 a extending upwardly therefrom. Each of the lower legs 311*a* has an indentation 312*a* tapered downward. The U-shaped iron core 31*a* is able to be firmly engaged with the U-shaped armature 30*a* by an engagement between the indentations 312*a* and the protrusions 302*a*.

Figure 7:
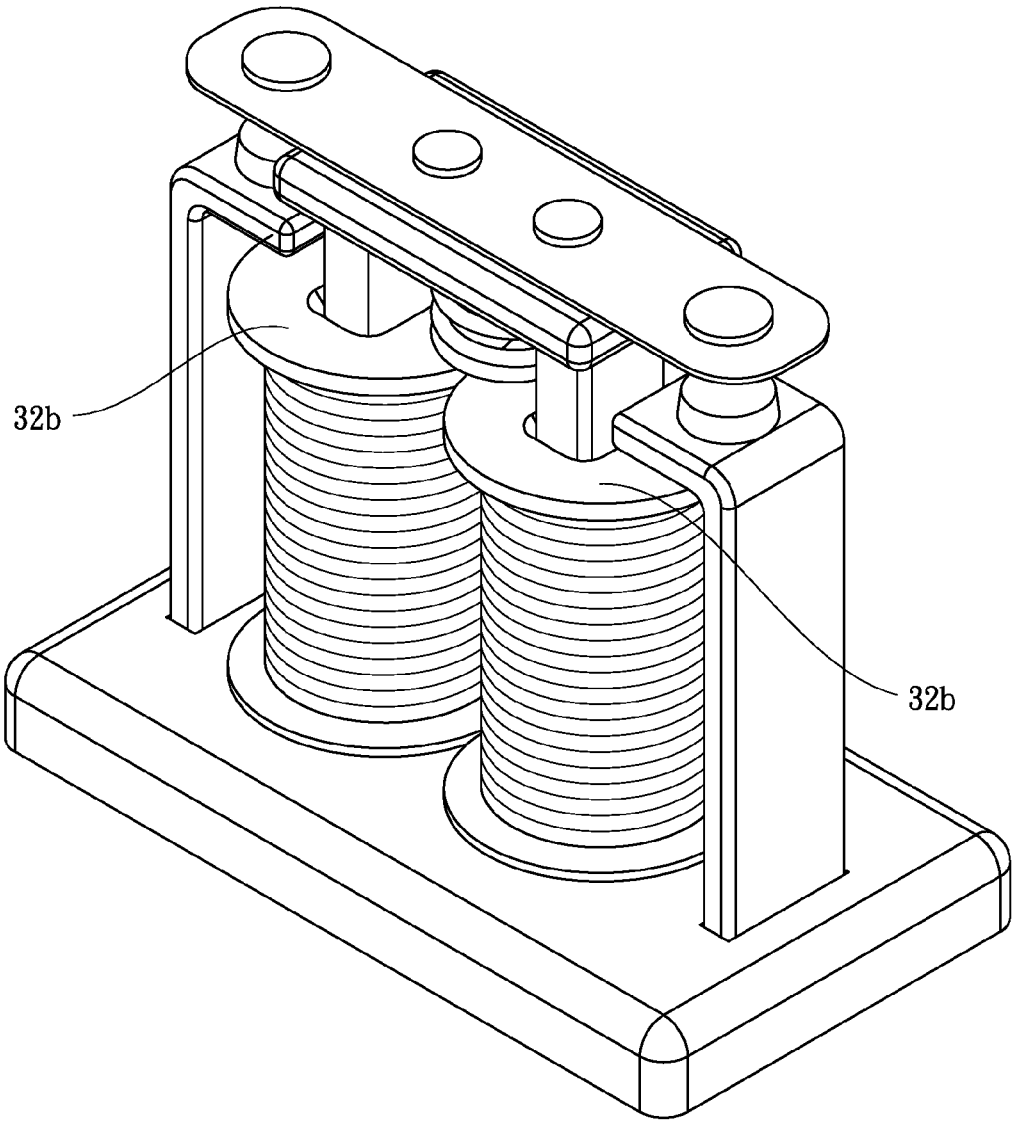
FIG. 7 is a perspective view of a third embodiment of the relay with multiple coils in accordance with the present invention.

With reference to FIG. 7, that shows a third embodiment of the relay with multiple coils in accordance with the present invention. The elements and effects of the third embodiment which are the same with the preferred embodiment are not described, only the differences are described. In this embodiment, each tubular bobbin 32*b* has a round cross section and coaxially received between the upper legs 301 of the U-shaped armature 30 and the lower legs 311 of the U-shaped iron core 31.

Therefore, the induced magnetic field of the conventional relay with a single coil maybe enhanced without changing the input voltages by increasing a length or a diameter of the coil or increasing a length of the iron core. The relay with multiple coils in accordance with the present invention overcomes above disadvantages by providing the multiple coils to increase the induced magnetic field and enhance the operation of the relay.

Although the invention has been explained in relation to its preferred embodiment, it is to be understood that many other possible modifications and variations can be made without departing from the spirit and scope of the invention as hereinafter claimed.

What is claimed is:

1. A relay comprising:

a base;

a pair of support members disposed on the base;

two fixed contacts formed on the support members respectively;

an iron core mounted on the base and formed in a U shape with two legs extending upward;

two bobbins mounted about the two legs of the iron core;

two coils wound on the respective bobbins;

an armature formed in an inverted-U shape with a middle section and two legs extending down from the middle section through the respective bobbins toward the two legs of the iron core;

a spring member joined to the armature;

an insulator enclosing the middle section of the armature to isolate the armature from the spring member;

two moving contacts formed on the spring member to be coupled with the fixed contacts; and a coil spring biased between the middle section of the armature and at least one of the two bobbins to normally urge the armature to an upper position where the fixed contacts and the moving contacts are spaced apart;

wherein when electric power is supplied to the coils, the armature is actuated by the iron core to press against the coil spring, and the spring member moves downward with the armature to have the moving contacts in contact with the fixed contacts.

2. The relay as claimed in claim 1, wherein each of the legs of the armature has an indentation tapered upward and each of the legs of the iron core has a protrusion tapered upward to be fit in the indentation in the armature.

3. The relay as claimed in claim 1, wherein each of upper the legs of the armature has a protrusion tapered downward and each of the lower legs of the iron core has an indentation tapered downward to receive the respective protrusion of the armature.

4. The relay as claimed in claim 1, wherein each bobbin has a round cross section.

5. The relay as claimed in claim 1, wherein each bobbin has a square cross section.

6. The relay as claimed in claim 1, wherein each of the support members is erected on the base and formed in an inverted-L shape with an laterally oriented end portion; each of the fixed contacts is placed on a top surface of the respective laterally oriented end portion of the support member;

and the moving contacts are placed on a bottom surface of the spring member to be coupled with the fixed contacts.

* * * * *